United States Patent [19]

Lopez et al.

[11] Patent Number: 4,692,805

[45] Date of Patent: Sep. 8, 1987

[54] DEVICES USED FOR VARYING THE RESISTANCE OF ELECTRICAL CIRCUITS AND THE CONDUCTION OF CURRENT IN ELECTRICAL CIRCUITS

[75] Inventors: Carlos Lopez; Jose L. Serrano, both of Tudela, Spain

[73] Assignee: Piher Navarra, S.A., Tudela, Spain

[21] Appl. No.: 694,043

[22] Filed: Jan. 23, 1985

[30] Foreign Application Priority Data

Jan. 24, 1984 [ES] Spain ..... 529.109

[51] Int. Cl.[4] ..... H01C 10/50

[52] U.S. Cl. ..... 338/198; 338/178; 338/200

[58] Field of Search ..... 338/198, 174, 178, 173; 200/62, 63 R

[56] References Cited

U.S. PATENT DOCUMENTS

| | | | |
|---|---|---|---|
| 2,318,768 | 5/1943 | Foster et al. | 338/173 |
| 3,644,865 | 2/1972 | Kirby et al. | 338/173 |
| 3,833,783 | 9/1974 | Tanaka et al. | 338/198 X |
| 3,896,410 | 7/1975 | Matthews et al. | 338/173 |
| 3,952,278 | 4/1976 | Kiyono | 338/198 |

*Primary Examiner*—E. A. Goldberg
*Assistant Examiner*—M. M. Lateef

[57] ABSTRACT

A device forming a potentiometer for varying the resistance of an electrical circuit, and a switch for changing the state of current conduction in the circuit. The switch has a casing fastened to the potentiometer, and the potentiometer has a casing and a plate joined together. The device has a rotatable component having a central protuberance extending through the plate. A first discoidal element is carried by the rotatable component and has a metallic cursor. A resistance track and a metallic collector are stationarily mounted on the plate. The cursor is continuously and simultaneously in contact with the resistance track and the collector. A second discoidal element is mounted in the switch casing for engagement by the protuberance and is releasably coupled to the rotatable component when the switch is coupled to the potentiometer. A fixed contact is mounted on the switch casing and a movable contactor arm is movable mounted on the switch casing.

10 Claims, 10 Drawing Figures

DEVICES USED FOR VARYING THE RESISTANCE OF ELECTRICAL CIRCUITS AND THE CONDUCTION OF CURRENT IN ELECTRICAL CIRCUITS

BACKGROUND OF THE INVENTION

The present invention relates to a device for varying the resistance of electrical circuits (a potentiometer) in combination with a device for changing the state of a current conductor (electrical switch).

Such devices are widely employed as components in various forms and sizes in electronic assemblies, industrial control and regulation installations, and the like.

The combination of a potentiometer with a switch for changing the electrical conduction in the same or in another circuit, is a useful feature in the operation of many types of electronic assemblies and installations in industrial, professional, and retail application.

The improvements herein described contribute to the rationalization of production of the devices in question insofar as, given the specific function carried out by each of them, they can be manufactured as separate components, namely a device for the progressive variation of electrical resistance, and a device for instant change in electrical conduction, respectively. The two devices can then be functionally combined, both having been provided with means by which their respective moving parts can fulfill their function in mutual coordination, a rotary motion through common control means.

Thus, when the cursor of the potentiometer has traced out its full angle of movement and reached one extremity of its resistance track, a continuity change will occur, for example the switch will open. On reversing the rotational movement applied to the control means of the variable resistance device another continuity change will occur, in the reverse sense to the previous one, that is to say, the switch will close, while also producing a variation, in the reverse sense to the previous variation, of the electrical resistance which exists between each of the terminals of the resistance track and the cursor.

Another characteristic of the combined device of this invention is the possibility of each of the two components being assembled automatically. The assembly process of the respective components is independent, and the two can then be combined subsequent to the completion of their respective assemblies.

In a preferred version of the assembly procedure of the variable resistance, the metal parts thereof, consisting principally in the terminals contacting the extremities of the resistance track and the collector leading to another terminal, are obtained by stamping from a sheet metal strip having the appropriate characteristics, in a continuous feed system on an assembly line. The preferred version would utilize, for example, an electrolitic brass strip which would undergo a primary stamping operation producing the approximate form of the terminals and the collector, passing them to a metallization process applying a different metal to the two respective faces, such as tin and nickel or copper. The stamped out metallized strip can then proceed, without need of any supplementary support, to the assembly machine, wherein it will receive its final cut to shape, with the parts being formed into their characteristic structure, ready for immediate assembly, with the other parts making up the respective device.

In this manner are produced equally the continuity change devices for combination with the variable resistance devices and which can be attached to the former when it is required to make up one single functional unit with one common control, resulting thus in a pair of devices in combination in one body. The attachment of the body to a support, such as the frame of a machine, or an electronic assembly, presents no difficulty and the terminals which are accessible can be connected to the extremities of the conductors associated with diverse components comprising the remainder of the circuit in question.

The improvements to be described cover the production of the variable resistance device in such a manner that in the absence of the continuity change device the component carrying the rotating cursor terminates in a coaxial extension which can remain free, with no specific purpose. When it is required to effect a combination of the two devices the central extended prolongation of the cursor carrying component is coupled mechanically to the component of the continuity change device which has to actuate the moving part carrying a contact point which eventually comes into contact with a similar contact point on a fixed part of the device.

BRIEF DESCRIPTION OF THE DRAWING

The attached drawings show, by way of an illustrative but not limitative example, an embodiment of improvements in the devices for varying the resistance and for changing the current continuity in electrical circuits.

DETAILED DESCRIPTION OF A PREFERRED EMBODIMENT

Figure 1:
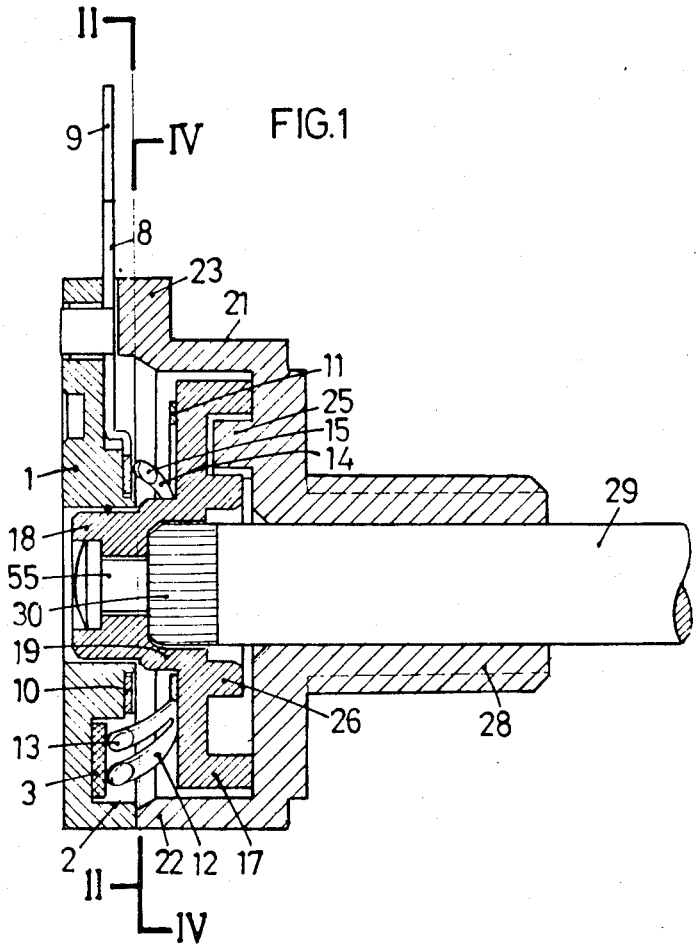
FIG. 1 is a cross section through the center of a potentiometer according to the present invention.

The device according to the invention takes the form of a unit, with a characteristic mechanical structural strength and safety as to its electrical contact arrangement, suitable for employment in electronic assemblies on printed circuit boards, as well as with assemblies comprising discrete and integrated components.

The primary support component for one part of the unit, the variable resistance device, or potentiometer, consists of a quadrangular plate 1 made of an insulating material, such as a dielectric ceramic or the like, which has provided on one face designed to form one of the inside faces of the device, a circular recess 2 for a resistor track 3. The latter consists of a strip member of insulating material in the shape of an omega and has on one of its faces a graphitic element on which a cursor 11 will travel. Extremities 4 of the track have permanently attached thereto terminals 5, one at each extremity, with mechanical and electrical joints at junctions 6, and end sections 7 which in the example shown represent spade-shaped terminals suitable for insertion in connection sockets provided for this purpose on an insulating board of a printed circuit.

The cursor 11 is designed to rest on a corona-shaped collector 10 lying coaxially with the resistor track 3 and extending to a terminal 8 which in turn ends in an end section 9 similar to the spade-shaped ends 7 and which may be referred to as a collector terminal.

Figure 4:
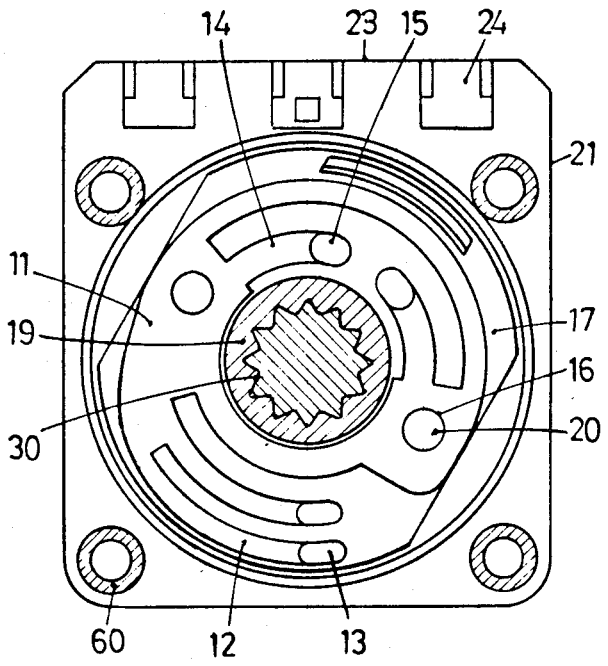
FIG. 4 is another transverse section, taken along line IV—IV of FIG. 1.

The cursor 11 is manufactured from sheet brass or other material with excellent electrical and mechanical properties and has the shape of the letter "e" (FIG. 4), with curved extensions 12 terminating in contactor zones 13 which travel along the resistor track 3. A further set of extensions 14 in opposite direction form points 15 which travel along the metal corona-shaped collector 10, both extensions being connected to the cursor 11.

Holes 16 in cursor 11 permit passage therethrough of studs 20 for the attachement to a support plate 17, which has at its central part a tubular protuberance 18 with an intermediate portion 19 around which is situated the cursor 11.

A casing 21 together with the plate 1 completes the body of the potentiometer. One side of plate 21 has an extension 23 on which there are lugs 24 for terminals. An internal protuberance 25 corresponds to a circular protuberance 26 which is formed on the cursor support plate 17 and which is provided with an appendix which serves to limit the rotary travel of an axial spindle 29, serving as control means, thus forming a mechanical travel limit stop with the internal protuberance 25.

Axial spindle 29 is guided by a tubular extension 28, and a head 30 of spindle 29, having a star-shaped cross section is fitted into a cavity of the same shape in intermediate portion 19, while a head 55 of spindle 29 fits into protuberance 18.

The exterior of the tubular extension 28 is screw-threaded and can be attached to a sheet metal or other support by means of a nut and a locking washer (not shown). Thus, the variable resistance device, or potentiometer, and the current continuity device, or electrical switch, can be attached to each other.

Figure 3:
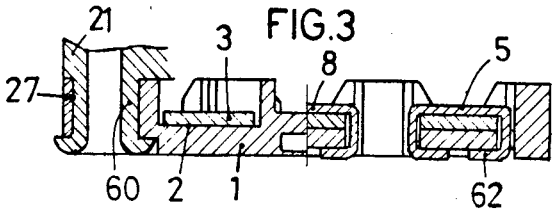
FIG. 3 is a cross-section along line III—III of FIG. 2.
Figure 2:
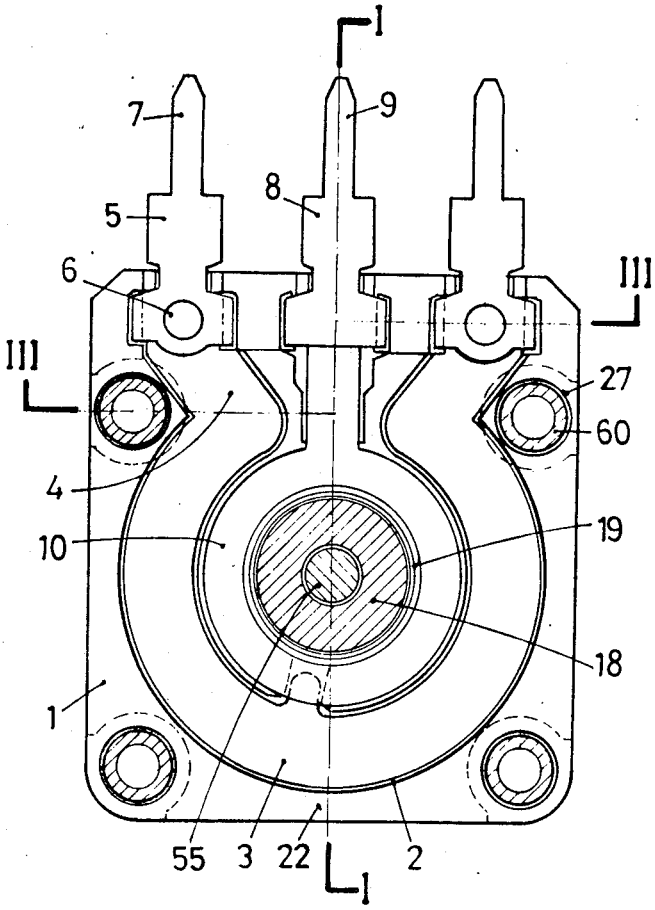
FIG. 2 is a transverse section taken at line II—II in FIG. 1.

The attachment of plate 1 to the edges 22 of casing 21 is accomplished by means of a system of rivets, as shown in FIG. 3. More specifically, tubular extensions 60 of casing 21 are inserted into holes 27 in plate 1, diagonally opposed to each other, and are then rivetted. The terminals 5 of the potentiometer are attached to plate 1 by means of prolongations of the terminals extending therefrom and formed around the exterior face of plate 1 at 62 (FIG. 3).

Figure 5:
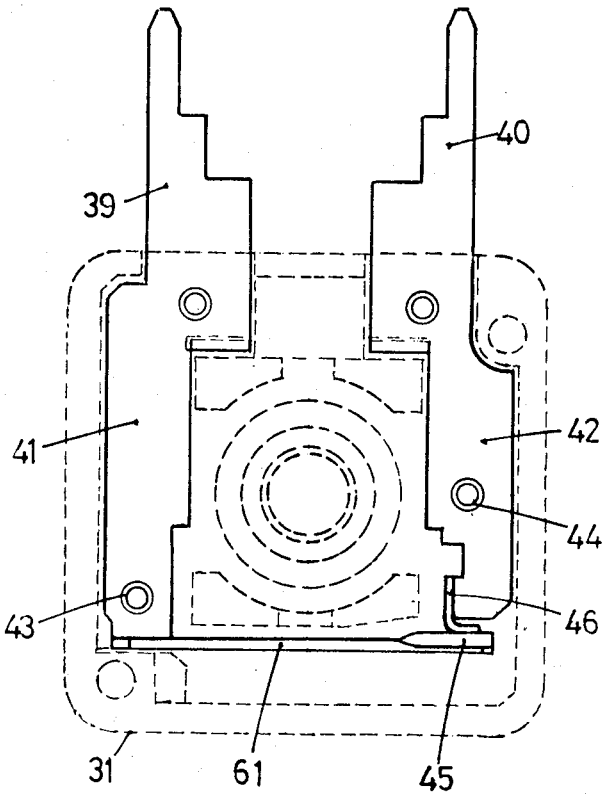
FIGS. 5 and 6 show part of the structure of the electrical switch, with conductor bars which form the moving and fixed members.
Figure 6:
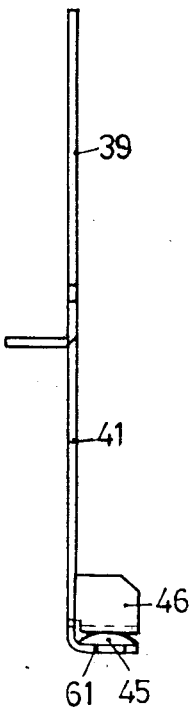

FIGS. 5 and 6 show the quadrangular prismatic shape of a protective casing 31 of the current continuity device, to be attached to the variable resistance device on its mutually common face 32 (FIG. 9), for instance by means of tubular rivets inserted in holes 33 passing through casings 23 and 31 and which are located diametrically opposite near two of the edges.

The component 31 of the protective body casing of a flat configuration, has on one of its faces two gaps 34 (FIG. 9) to allow for the passage of the connection terminals for the current continuity change device and within its inside face it has symmetrical projections 35, parallel to that side, with projections 36 and 37, differing one from the other, but arranged symmetrical to the previous ones and with respect to a central orifice 38. The special shape of the projection 37 is a function of the operation of the device, specifically to secure the type of movement of the actuating member with respect to the moving component of the change mechanism.

Terminals 39 and 40 in the form of steps, (FIGS. 5 and 8) are extensions of metal strips 41 and 42, respectively, fitted within the interior of casing body 31 by means of pins 43 and 44 so as to secure them firmly. Strip 41 extends downwardly to form a flexible arm 61 and which constitutes the moving component of the switch and carries at its extremity a contact pad 45. Strip 42 extends to form at its extremity an elbow 46, being a fixed contact member which establishes an electrical and mechanical connection eventually with pad 45 if the latter is not displaced by an eccentric 47 acting on it.

Figure 9:
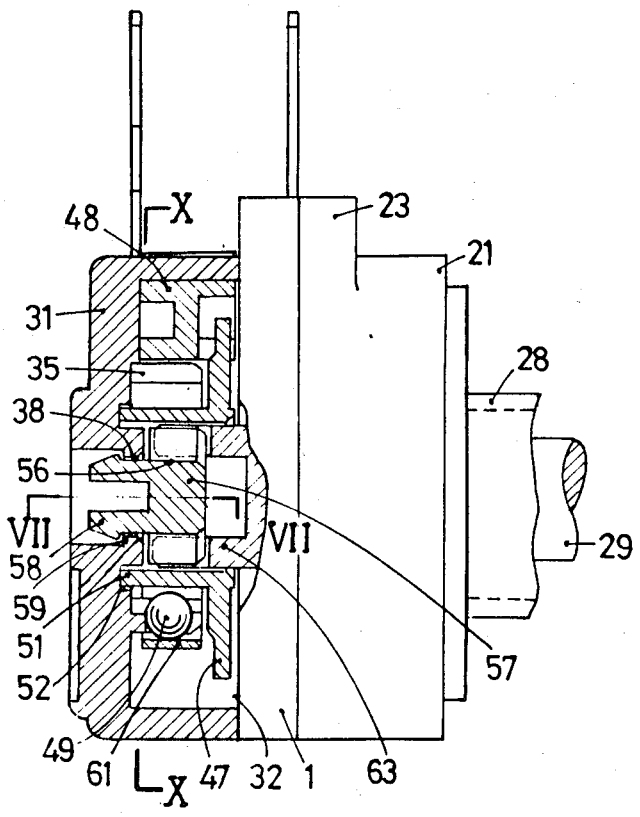
FIGS. 8 and 9 show the assembly of the combined potentiometer and switch of the invention.
Figure 8:
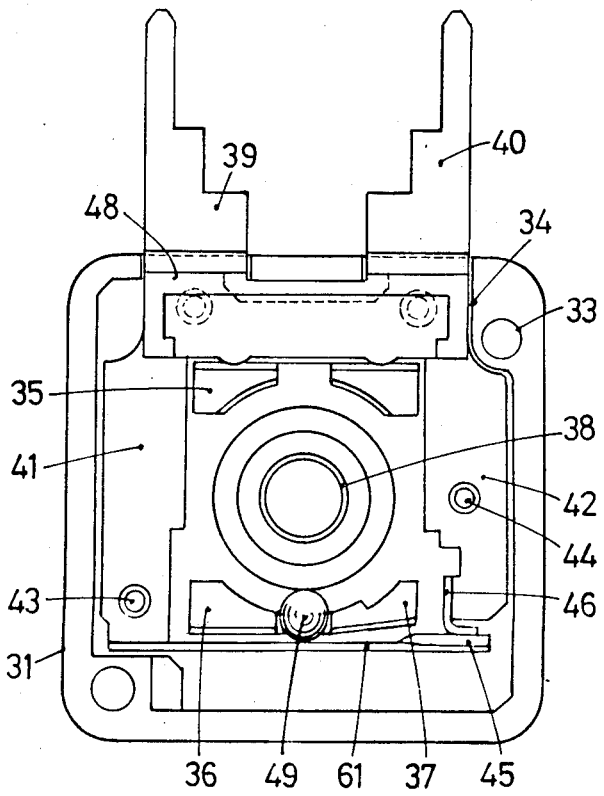

A cross member 48 holds the contact terminals in position by having gaps in its wider faces, extends transverse to the terminals, and is located as evident from FIGS. 8 and 9.

Figure 10:
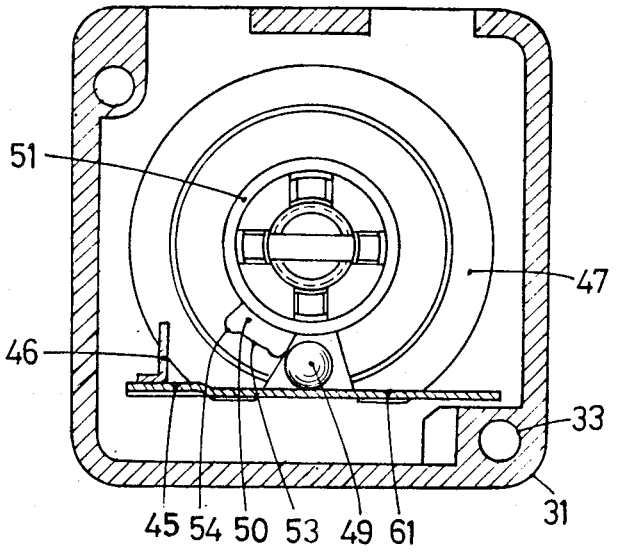
FIG. 10 shows a detail of an actuating member of the switch.

The separation of the moving arm 61 and its end contact pad 45 from the fixed contact 46 occurs when a ball 49 of stainless metal is pushed against moving arm 61, due to the effect of the rotation of the cam formed by a protuberance 50 (FIG. 10) extending from corona-shaped component 47. Component 47 is part of a tubular member 51 which is lodged in a cavity 52 which has been provided in casing body 31 (FIG. 9). Protuberance 50 has a central recess 53 and two lateral shoulders 54 rounded off so as to facilitate contact with ball 49.

Corona-shaped component 47 causes the actuation of the switch and is in turn actuated by axial spindle 29 of the potentiometer to which the device is atttached, by means of projections 63, (of which preferably there are four). Projections 63 are longitudinal and symmetrical extensions of protuberance 18 and engage mating recesses 56 which are provided in the external face of component 47. Thus, projections 63 extending beyond the front extremity of the potentiometer couple into the switch, cause and determine its mode of rotation, and the opening and closing of the contacts which allow for the conduction or interruption of the current in an electric circuit.

Figure 7:
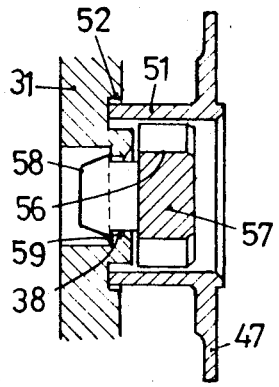
FIG. 7 shows a section along line VII—VII of FIG. 9.

Corona-shaped component 47 with its tubular extension 51 is attached to casing body 31 by means of a central expanded section 57 developed into two extended sections 58. The shape of these allows a certain degree of flexibility and hence a temporary deformation and their insertion through a central orifice 38 of casing body 31. Their insertion is facilitated by their conical external shape, and a lateral groove 59 prevents them from becoming detached accidentally, as may be seen from FIGS. 7 and 9.

The variable resistance device in a circuit may be combined with one or more other devices on the same class, for the provision of variation in the resistance of other mutually independent circuits but having a simultaneous operation and of which the moving parts would be actuated by the same rotational axial spindle. In such cases the rotating cursor supports will be coupled together by means of intermediate components transmitting the rotary motion from one member to another, in a simultaneous movement, that is to say at the same angular velocity. The group of variation devices can carry, on the end opposed to that of the actuating axial spindle, the device for changing the state of current conduction of a circuit which will come into operation once the group of moving members of the variation devices will have reached the end of their travel.

We claim:

1. A device forming a combined potentiometer and switch, comprising: a rotatable component having a central protuberance thereon; a potentiometer portion for varying the resistance of an electrical circuit, said potentiometer portion including a casing and a plate joined together to form a body for said potentiometer, said rotatable component extending into said potentiometer body and having a portion of said central protuberance extending through said plate; a first discoidal component carried by said rotatable component; a metallic cursor connected to said discoidal component; a resistance track stationarily mounted on said plate in said body; a metallic collector stationarily mounted on said plate in said body; said cursor being continuously and simultaneously in contact with said resistance track and said collector; a switch portion for changing the state of current conduction in the electrical circuit, said switch portion including a switch protective casing; a second discoidal component mounted in said switch protective casing for engagement by the portion of said central protuberance which extends out of said potentiometer body; cooperating means on the portion of said central protuberance extending through said plate and on said second discoidal component for releasably coupling said second discoidal component to said rotatable component when said switch portion is coupled to said potentiometer portion whereby said second discoidal component can be rotated by said rotatable component; a fixed contact mounted on said switch protective casing; a movable contactor arm movably mounted on said switch protective casing; a contact means on said movable contactor arm for contacting said fixed contact for establishing electrical connection in the electrical circuit; means for moving said movable contactor arm to move said contact means out of contact with said fixed contact and including means connected to said second discoidal component to move said movable contact arm when said rotatable component is rotated; and further including fastening means for connecting said potentiometer body to said switch protective casing.

2. A device according to claim 1, wherein said housing comprises a pair of metallic strips having first ends extending from said casing and forming terminals of said device, and also having second ends respectively forming said movable contactor arm and a fixed contact point.

3. A device according to claim 1, wherein said second discoidal component has an appendix; said contactor arm having recess means; a metallic sphere in said recess means, and a set of protuberances on said appendix for radially displacing said sphere and thereby actuate said contactor arm.

4. A device according to claim 3, wherein said second discoidal component has a plurality of parallel and equidistant extensions inserted in corresponding grooves in said rotatable component.

5. A device according to claim 1, comprising means for limiting the angle of rotation of said rotatable component.

6. A device according to claim 1, wherein said resistance track is corona-shaped and of insulating material and said metallic collector is corona-shaped, coaxial with and of smaller diameter than said resistance track.

7. A device according to claim 1 wherein said switch protective casing is attached to said potentiometer plate.

8. A device according to claim 1 wherein said cooperating means includes projections on said central protuberance and recesses in said second discoidal component.

9. A device according to claim 1 further including attaching means for attaching said second discoidal component to said switch protective casing, said attaching means including an expanded element having a plurality of extended sections with shoulders thereon and a central bore in said switch protective casing with shoulders thereon for cooperating with said expanded element shoulders.

10. A device according to claim 9 wherein said attaching means further includes a groove defined in said switch protective casing adjacent to said central bore.

* * * * *